US010713981B2

(12) United States Patent
de Grasse et al.

(10) Patent No.: US 10,713,981 B2
(45) Date of Patent: Jul. 14, 2020

(54) INFLATABLE DISPLAY ASSEMBLY FOR DETACHABLE EXTERNAL AIR BLOWER

(71) Applicant: Aqua-Leisure Industries, Inc., Avon, MA (US)

(72) Inventors: Scott R. de Grasse, Marshfield, MA (US); Jesse Kane, Mansfield, MA (US)

(73) Assignee: Aqua-Leisure Industries, Inc., Avon, MA (US)

( * ) Notice: Subject to any disclaimer, the term of this patent is extended or adjusted under 35 U.S.C. 154(b) by 25 days.

(21) Appl. No.: 15/838,491

(22) Filed: Dec. 12, 2017

(65) Prior Publication Data

US 2018/0174499 A1 Jun. 21, 2018

Related U.S. Application Data

(60) Provisional application No. 62/434,728, filed on Dec. 15, 2016.

(51) Int. Cl.

| | |
|---|---|
| ***G09F 19/08*** | (2006.01) |
| ***A63H 3/06*** | (2006.01) |
| *A63H 27/10* | (2006.01) |

(52) U.S. Cl.

CPC ..... *G09F 19/08* (2013.01); *A63H 3/06* (2013.01); *A63H 2027/1008* (2013.01); *A63H 2027/1033* (2013.01); *A63H 2027/1083* (2013.01)

(58) Field of Classification Search

CPC ... G09F 19/08; A63H 3/06; A63H 2027/1008; A63H 2027/1083; A63H 2027/1033

See application file for complete search history.

(56) References Cited

U.S. PATENT DOCUMENTS

| | | | | |
|---|---|---|---|---|
| D328,640 | S | 8/1992 | Conger, IV | |
| 5,931,207 | A | 8/1999 | Gianino | |
| D422,351 | S | 4/2000 | Griffin | |
| 6,474,373 | B1 * | 11/2002 | Sejnowski | E04H 4/0025 141/100 |
| 6,568,611 | B1 * | 5/2003 | Essenmacher | F04D 29/441 239/289 |
| 6,793,469 | B2 | 9/2004 | Chung | |
| 6,892,772 | B1 * | 5/2005 | Wang | A63H 27/10 141/114 |
| D530,002 | S | 10/2006 | Ching | |
| D540,455 | S | 4/2007 | Ferraro, Sr. | |
| 8,635,794 | B1 * | 1/2014 | Thigpen | A63H 3/06 40/539 |
| 9,861,901 | B1 * | 1/2018 | Pierzynski | A63G 31/12 |
| 2006/0107573 | A1 * | 5/2006 | Machala | G09F 15/00 40/610 |
| 2006/0230655 | A1 * | 10/2006 | Machala | G09F 19/00 40/410 |
| 2007/0022642 | A1 * | 2/2007 | Hsu | G09F 15/0025 40/419 |
| 2009/0050234 | A1 * | 2/2009 | Zaar | F41H 3/00 141/231 |

* cited by examiner

*Primary Examiner* — Nicolas A Arnett
(74) *Attorney, Agent, or Firm* — Wolf, Greenfield & Sacks, P.C.

(57) ABSTRACT

An inflatable display assembly includes a base member to which the inflatable body is permanently attached. The base member has a channel therethrough, one end of the channel being affixed to an opening in the fabric of inflatable body. An external air blower unit may be removably attached to base member at one end of said channel to provide a flow of air through the base member and then into the inflatable body.

5 Claims, 6 Drawing Sheets

INFLATABLE DISPLAY ASSEMBLY FOR DETACHABLE EXTERNAL AIR BLOWER

RELATED APPLICATION

This application claims priority under 35 U.S.C. Section 119(e) to U.S. Provisional Application Ser. No. 62/434,728 entitled "INFLATABLE FIGURE ASSEMBLY WITH DETACHABLE EXTERNAL AIR BLOWER," filed on Dec. 15, 2016, which is hereby incorporated by reference in its entirety for all purposes.

FIELD OF THE INVENTION

This invention relates to air-blown inflatable displays, and particularly to a device which may be affixed to the display and which permits ready attachment and detachment of an external air blower to inflate the display via a channel through the device.

SUMMARY OF THE INVENTION

Inflatable displays have become popular lawn ornaments, particularly during the holiday seasons. Inflatable witches and pumpkins appear at Halloween, Santa Claus and reindeer at Christmas, and so forth. An air blower provides a continuous flow of air into the body of the inflatable display, which is constructed of air permeable fabric. Once the body is filled with air, excess air escapes through the fabric while the incoming flow of air causes the display to retain its inflated shape.

Rather than have the air blower permanently attached to the inflatable body, as in some products on the market, it is desirable that the blower be readily detachable so that a single blower device may be employed for different displays: e.g., the witch at Halloween and the Santa Claus display at Christmas.

U.S. Pat. No. 7,302,769 suggests the use of a lightweight, interchangeable fan assembly that is joined to the fabric of the inflatable body without the need for a base unit, and without distorting the inflatable body to which the fan assembly is attached. U.S. Patent Application Publication US2006/0098421 depicts an air blower external to the inflatable body, with a fabric sleeve extending from the body to receive the flow of air from the blower. U.S. Pat. No. 7,198,538 depicts a base unit mounted under and attached to the inflatable body, the air blower being fixed within the base unit, whereby air is drawn by the blower through an inlet port in the bottom of the base and then directed upward through an outlet port and into the inflatable display.

The instant invention provides a base member to which the inflatable body may be permanently attached. The base member has a channel therethrough, one end of the channel being affixed at its perimeter to an opening in the fabric of the inflatable body. An external air blower unit may be removably attached to the other end of the channel in the base member to provide a flow of air through the base member and then into the inflatable body.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosures, the present specification shall control.

DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION OF THE INVENTION

Figure 1:
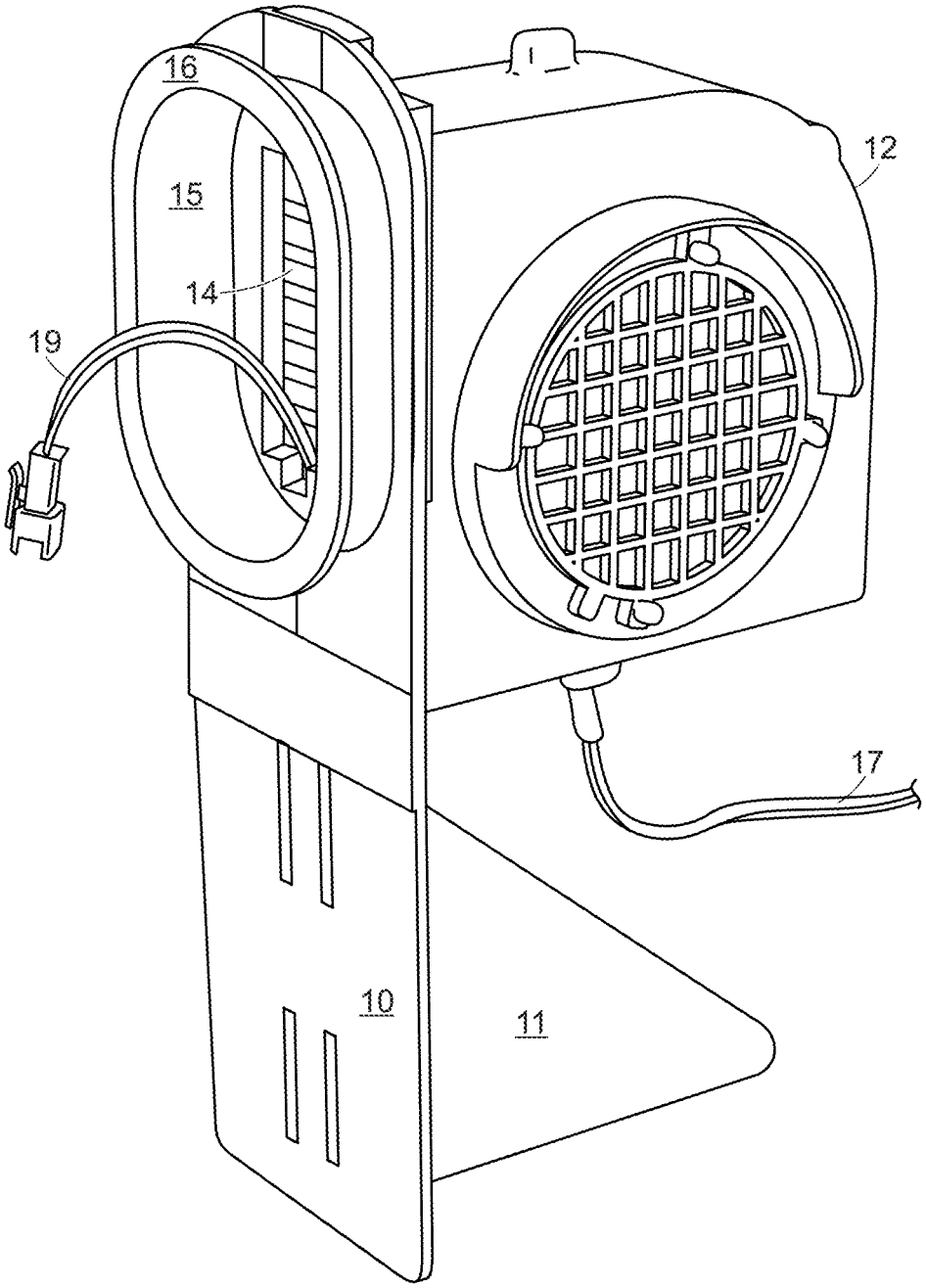
FIG. 1 depicts the base member of the instant invention, with the air blower unit attached thereto.
Figure 5:
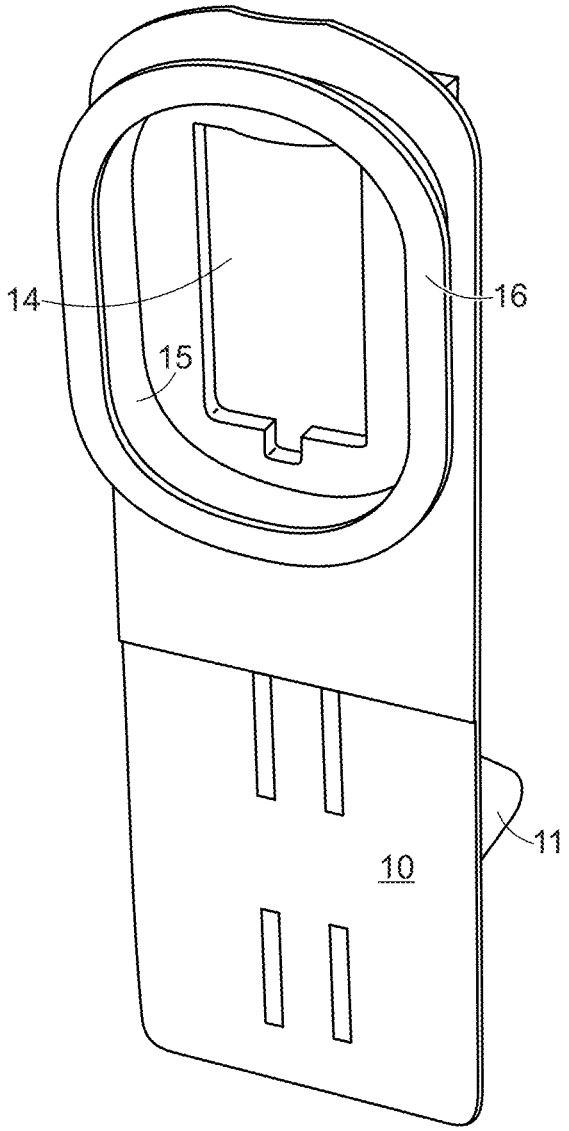
FIG. 5 depicts the side of the base member that is attached to the inflatable display.
Figure 6:
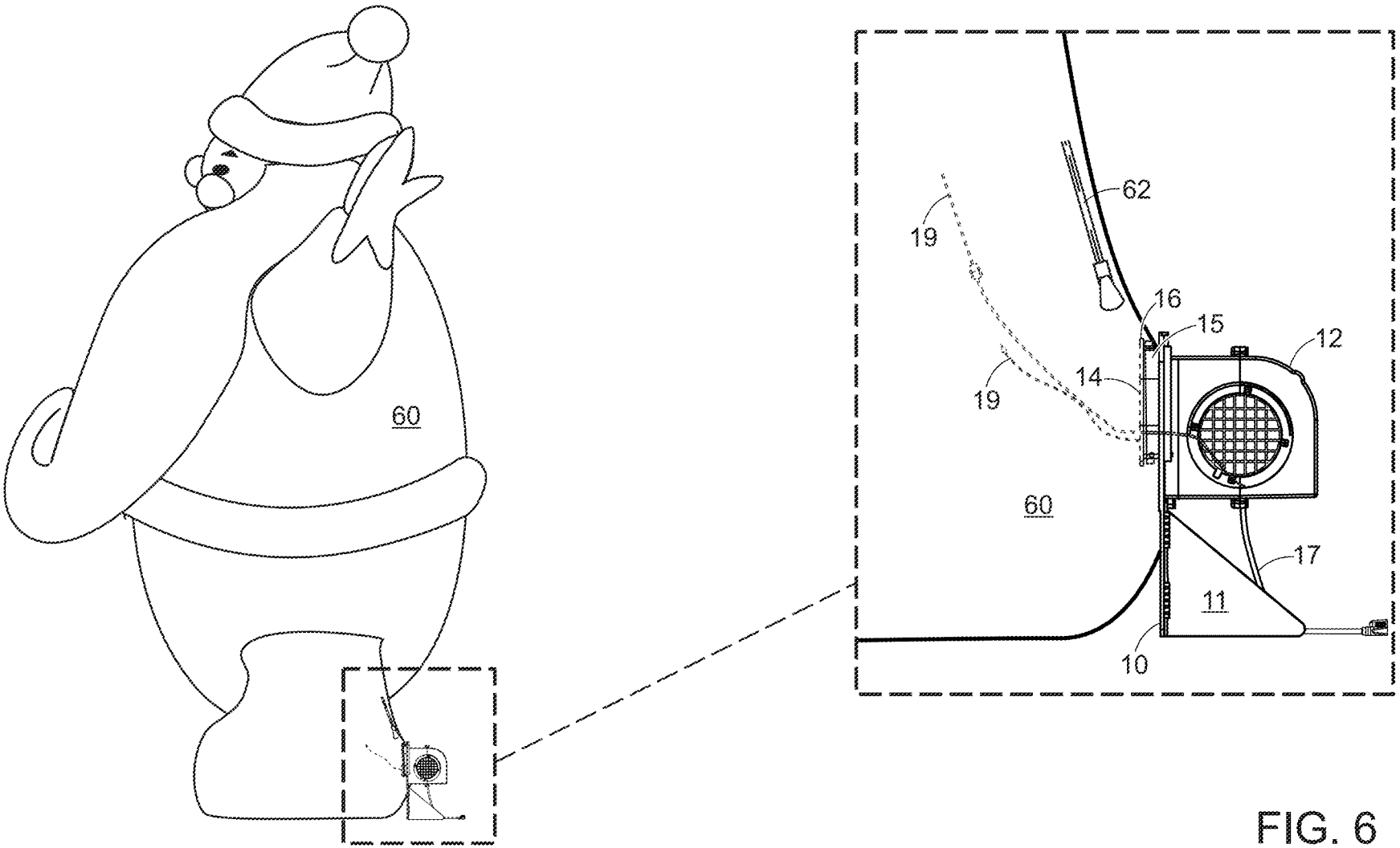
FIG. 6 depicts the base member and air blower assembly attached to an inflatable display.

Referring to FIGS. 1 and 5, air blower unit 12 is shown attached to base member 10 to provide a flow or air through opening 14 in said base member. Stabilizing fin 11 projects from base member 10, under air blower unit 12, to provide stability to the base member/air blower assembly, and to maintain the base member in a vertical position. Wall 15 projecting from base member 10 includes a circumferential ring 16 formed at its distal edge. As shown in FIG. 6, the "skin" or fabric of the inflatable display may be placed over ring 16 and suitably affixed at wall 15 (see FIG. 6) by known means, such as nylon "zip" ties (see FIG. 6).

Air blower unit 12 provides a flow of air into the channel formed by wall 15 of base member 10 to inflate the display, as explained below. Power cord 17 supplies electrical power to the fan within the blower unit, as well as to electrical wires 19 extending out of output vent 34 of the air blower (see FIG. 3) and through the opening 14 and into the inflatable display, where they may be connected to, for example, a string of lights within the inflatable display.

Figure 2:
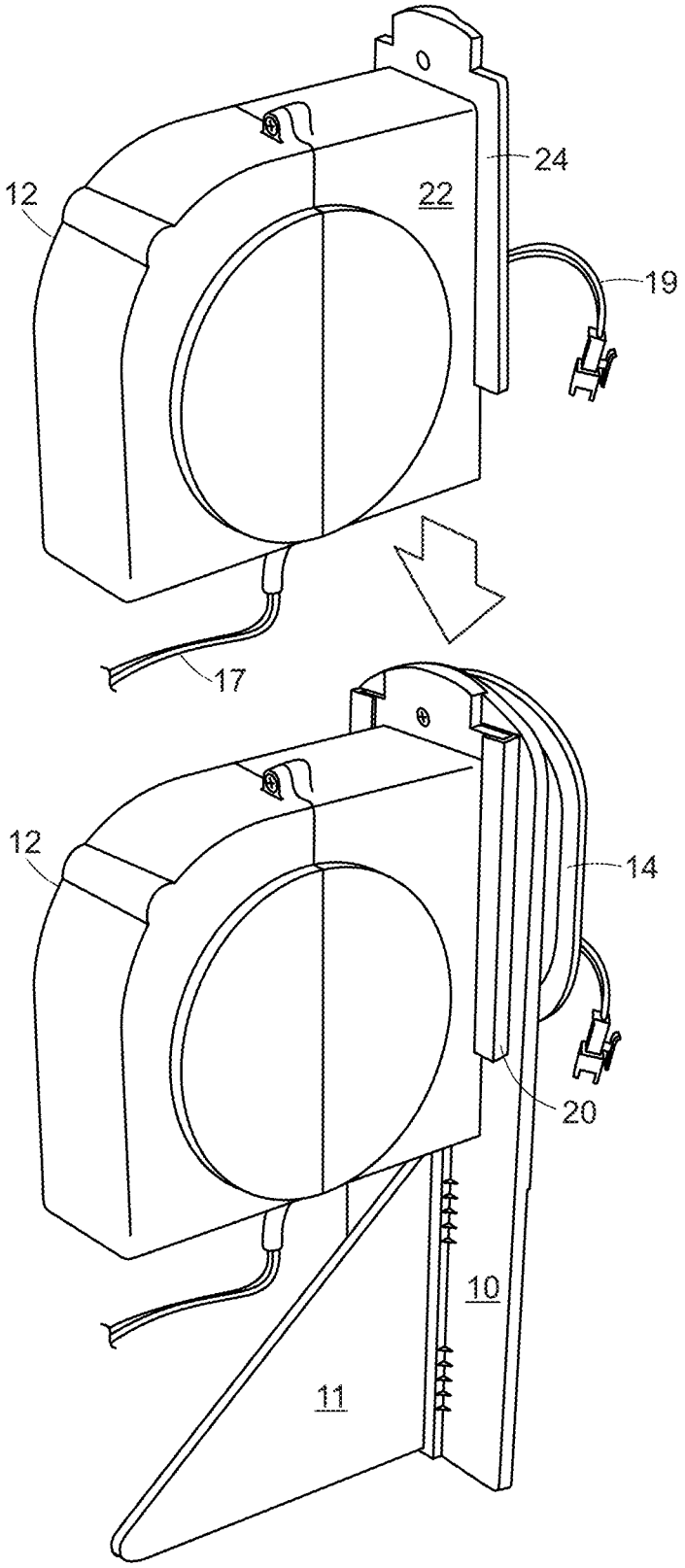
FIG. 2 illustrates a method and means for removably attaching the air blower assembly to the base member.
Figure 3:
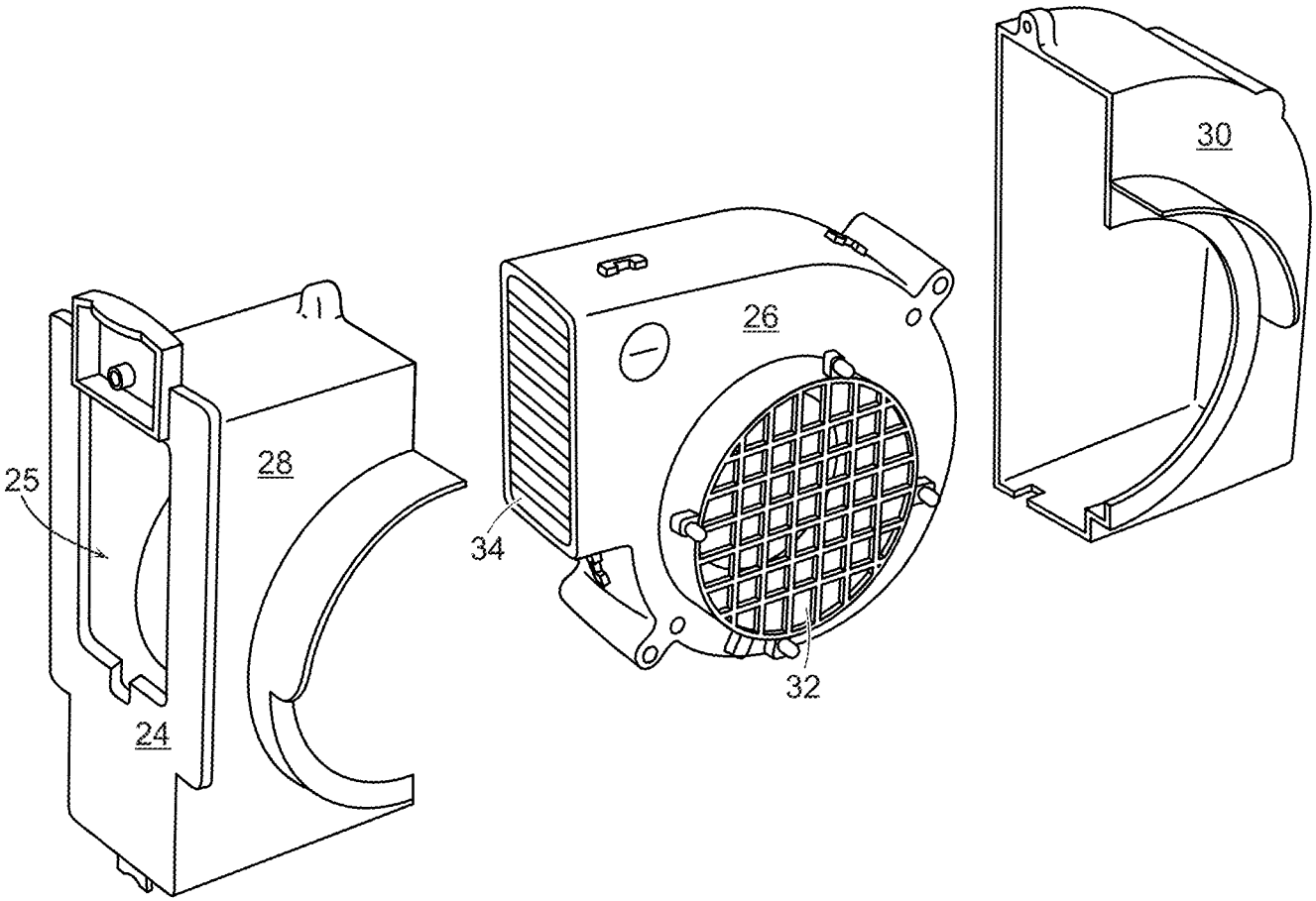
FIG. 3 depicts the components of the air blower unit, namely a fan enclosed within a surrounding protective cover.

As shown in FIG. 2, air blower unit 12 includes outer cover 22 having a substantially rectangular plate-shaped projection 24 extending therefrom, which projection slidably and removably mates with U-shaped slot 20 projecting from the wall of base member 10 on the opposite side from opening 14. As seen in FIG. 3, conventional fan 26, having inlet vent 32 and output vent 34, is enclosed within air blower cover 22, which cover is comprised of sections 28 and 30 (see FIG. 4 for final blower unit assembly), configured so that fan 26 may receive external air through inlet vent 32, and may provide an outward flow of air through output vent 34.

Figure 4:
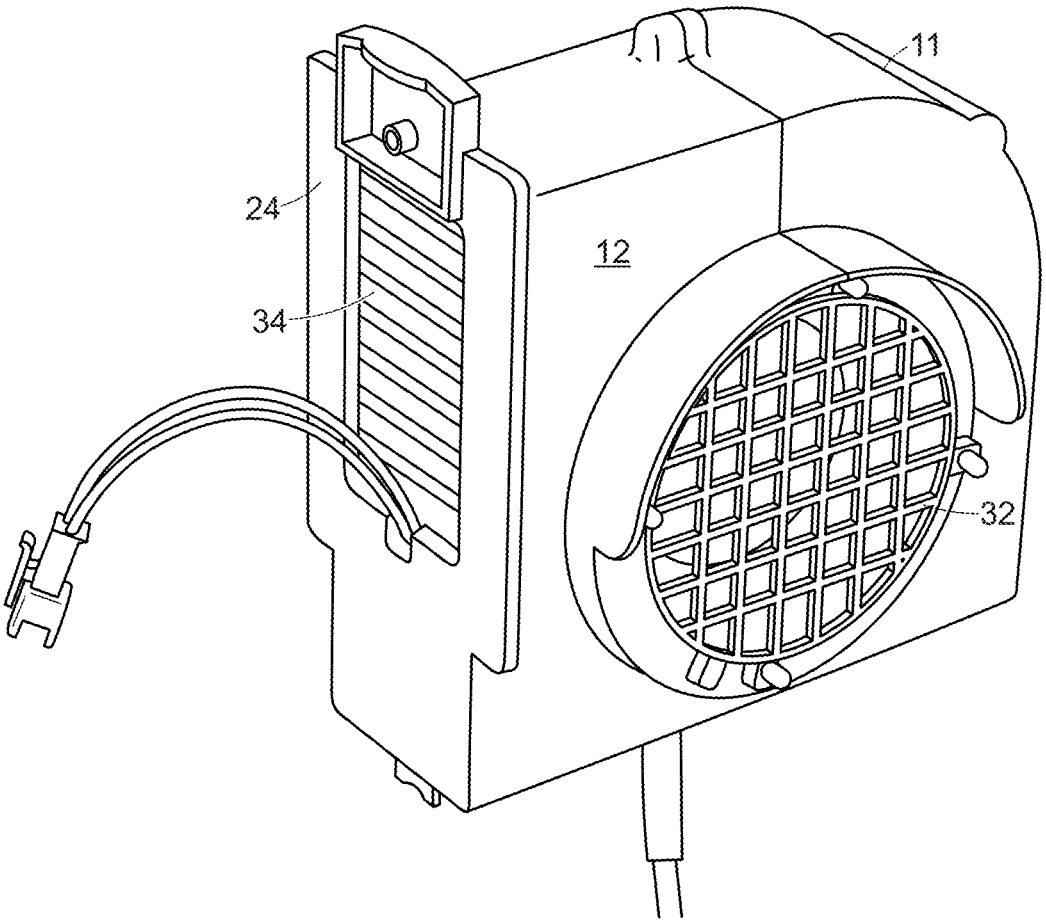
FIG. 4 depicts the fully assembled air blower unit.

As shown in FIG. 4, the air flow from outlet vent 34 of blower unit 12 passes through opening 25 (see FIG. 3) in plate-shaped projection 24 and then through base member 10 via opening 14 and into the inflatable display. Opening 25 is preferable of the same size and shape as opening 14 in base member 10.

FIG. 5 depicts the base member 10 as seen when looking into opening 14 and toward the outlet vent 34 of the air blower unit 12.

FIG. 6 depicts an inflatable display 60 attached to base member 10. Inflatable display 60 may include zippered opening 62 to permit, for example, connection of a string of lights to lighting wires 19 within the inflatable display.

As will be appreciated, the air blower unit 12 may be readily attached to base member 10 by sliding air blower housing 12 into adjacent attachment to base unit 10, plate-shaped projection 24 of outer cover 22 fitting within U-shaped slot 20 of base member 10. When it is desired to use the air blower with a different inflatable display, the air blower unit 12 may be slidably removed from its attachment to base unit 10, and re-attached in similar fashion to another inflatable display having a similar base unit construction.

From the description of at least one embodiment of the present disclosure, various alterations, modifications, and improvements will readily occur to those skilled in the art. Such alterations, modifications, and improvements are intended to be within the scope and spirit of the disclosure. Accordingly, the foregoing description is by way of example only and is not intended to be limiting.

While several embodiments of the present invention have been described and illustrated herein, those of ordinary skill in the art will readily envision a variety of other means and/or structures for performing the functions and/or obtaining the results and/or one of more of the advantages described herein, and each of such variations and/or modifications is deemed to be within the scope of the present invention. More generally, those skilled in the art will readily appreciate that all parameters, dimensions, materials, and configurations described herein are mean to be exemplary and the actual parameters, dimensions, materials and/or configurations will depend upon the specific application or applications for which the teachings of the present invention is/are used. Those skilled in the art will recognize or be able to ascertain using no more than routine experimentation, many equivalents to the specific embodiments of the invention described herein. It is therefore to be understood that the foregoing embodiments are presented by way of example only and that, with the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

We claim:

1. A device for connecting an external air blower to an inflatable body comprising:

a base member having a substantially planar side with a bottom edge and adapted for secure attachment to and outside of an inflatable body at an opening in the inflatable body, the base member having a channel therethrough in fluid communication with and affixable at its perimeter to the inflatable body at said opening to allow inflation of the inflatable body though said channel; and a stabilizing member having a bottom edge and attached to and extending substantially perpendicular to said planar side of said base member, the bottom edge of the planar side member and the bottom edge of the stabilizing member lying substantially in a plane and adapted to rest on the ground when the base member is attached to the inflatable body.

2. The device of claim 1, further comprising an air blower unit for inflating said inflatable body, said air blower unit having an outlet port removably attachable to the base member at one end of said channel to provide a flow of air from the air blower unit through said channel and into the inflatable body.

3. The device of claim 2, wherein the air blower unit comprises a fan and a detachable cover surrounding the fan, the outlet port of said unit being formed in said cover.

4. The device of claim 3, wherein the fan includes an inlet vent and an outlet vent, the fan being positioned within said detachable cover so that the outlet vent of the fan communicates with the outlet port of the cover of the air blower unit, to blow air outwardly through the outlet port of the cover.

5. The device of claim 2, further comprising a channel located within the base member to direct the incoming flow of air from the outlet port of the air blower unit through the channel in the base member and into said inflatable body.

* * * * *